US006873792B2

(12) United States Patent
Lo

(10) Patent No.: US 6,873,792 B2
(45) Date of Patent: Mar. 29, 2005

(54) MULTIPLE-SETTING PORTABLE DRYER AND CIRCUIT DESIGNS THEREOF

(75) Inventor: Teh-Liang Lo, Taipei Hsien (TW)

(73) Assignee: Tek Maker Corporation, Taipei (TW)

( * ) Notice: Subject to any disclaimer, the term of this patent is extended or adjusted under 35 U.S.C. 154(b) by 0 days.

(21) Appl. No.: 10/604,916

(22) Filed: Aug. 26, 2003

(65) Prior Publication Data

US 2005/0047765 A1 Mar. 3, 2005

(51) Int. Cl.[7] ..... F24H 3/00
(52) U.S. Cl. ..... 392/385; 34/97; 219/480; 392/384
(58) Field of Search ..... 392/379–385, 392/360, 363–369; 219/476, 480; 34/96–97

(56) References Cited

U.S. PATENT DOCUMENTS 1,607,195 A * 11/1926 Gross ..... 392/379
2,647,198 A * 7/1953 Lautner ..... 392/360
5,825,974 A * 10/1998 Hutton et al. ..... 392/360
6,327,428 B1 * 12/2001 Lo et al. ..... 392/385
6,408,131 B2 * 6/2002 Lo et al. ..... 392/385

FOREIGN PATENT DOCUMENTS

GB 2117194 * 10/1983

* cited by examiner

*Primary Examiner*—John A. Jeffery
(74) *Attorney, Agent, or Firm*—Winston Hsu

(57) ABSTRACT

A portable dryer includes a housing, a motor installed with a fan inside the housing, a power unit for supplying electric power to the portable dryer, a switch electrically connected to the power unit, and four heating filaments electrically connected to the power unit for generating heat. Power of the motor is related to power of the heating filaments.

32 Claims, 15 Drawing Sheets

Type I

| (I-1) | $R_M$ | $R_1$ | | $R_3$ | | Total |
|---|---|---|---|---|---|---|
| Resistance Ω = | 4.00 | 4.00 | | 1.00 | | 0.89 |
| Current DC I = | 2.00 | 2.00 | | 16.00 | | 18.00 |
| Voltage DC V = | 8.00 | 8.00 | | 16.00 | | 16.00 |
| Power DC W = | 16.00 | 16.00 | | 256.00 | | 288.00 |

| (I-2) | $R_M$ | $R_1$ | $R_2$ | $R_3$ | $R_4$ | Total |
|---|---|---|---|---|---|---|
| Resistance Ω' = | 4.00 | 4.00 | 2.86 | 1.00 | 1.00 | 0.46 |
| Current DC I' = | 2.82 | 1.18 | 1.64 | 16.00 | 16.00 | 34.82 |
| Voltage DC V' = | 11.29 | 4.71 | 4.71 | 16.00 | 16.00 | 16.00 |
| Power DC W' = | 32.00 | 5.55 | 7.76 | 256.00 | 256.00 | 557.31 |

$W'_M / W_M = 32.00/16.00 = 2$ $W'_{Total} / W_{Total} = 557.31/288.00 = 1.94$

Fig. 5

| Type II | | | | | |
|---|---|---|---|---|---|
| (II -1) | $R_M$ | $R_1$ | $R_3$ | | Total |
| Resistance Ω = | 4.00 | 4.00 | 1.00 | | 0.89 |
| Current DC I = | 2.00 | 2.00 | 16.00 | | 18.00 |
| Voltage DC V = | 8.00 | 8.00 | 16.00 | | 16.00 |
| Power DC W = | 16.00 | 16.00 | 256.00 | | 288.00 |
| (II -2) | $R_M$ | $R_2$ | $R_3$ | $R_4$ | Total |
| Resistance Ω' = | 4.00 | 1.67 | 1.00 | 1.00 | 0.46 |
| Current DC I' = | 2.82 | 2.82 | 16.00 | 16.00 | 34.82 |
| Voltage DC V' = | 11.29 | 4.71 | 16.00 | 16.00 | 16.00 |
| Power DC W' = | 32.00 | 13.28 | 256.00 | 256.00 | 557.28 |
| $W'_M / W_M = 32.00/16.00 = 2$ | | | | | |
| $W'_{Total} / W_{Total} = 557.28/288.00 = 1.94$ | | | | | |

Fig. 11

| Type III | | | | | |
|---|---|---|---|---|---|
| (III-1) | $R_M$ | $R_1$ | | $R_3$ | Total |
| Resistance Ω = | 4.00 | 4.00 | | 1.00 | 0.89 |
| Current DC I = | 2.00 | 2.00 | | 16.00 | 18.00 |
| Voltage DC V = | 8.00 | 8.00 | | 16.00 | 16.00 |
| Power DC W = | 16.00 | 16.00 | | 256.00 | 288.00 |
| (III-2) | $R_M$ | $R_1$ | $R_2$ | $R_4$ | Total |
| Resistance Ω' = | 4.00 | 4.00 | 2.86 | 0.50 | 0.46 |
| Current DC I' = | 2.82 | 1.18 | 1.64 | 32.00 | 34.82 |
| Voltage DC V' = | 11.29 | 4.71 | 4.71 | 16.00 | 16.00 |
| Power DC W' = | 32.00 | 5.55 | 7.76 | 512.00 | 557.31 |
| $W'_M / W_M$ =32.00/16.00=2 | | | | | |
| $W'_{Total} / W_{Total}$ =557.31/288.00=1.94 | | | | | |

Fig. 13

| Type IV | | | | |
|---|---|---|---|---|
| (IV-1) | $R_M$ | $R_1$ | $R_3$ | Total |
| Resistance Ω = | 4.00 | 4.00 | 1.00 | 0.89 |
| Current DC I = | 2.00 | 2.00 | 16.00 | 18.00 |
| Voltage DC V = | 8.00 | 8.00 | 16.00 | 16.00 |
| Power DC W = | 16.00 | 16.00 | 256.00 | 288.00 |
| (IV-2) | $R_M$ | $R_2$ | $R_4$ | Total |
| Resistance Ω' = | 4.00 | 1.67 | 0.50 | 0.46 |
| Current DC I' = | 2.82 | 2.82 | 32.00 | 34.82 |
| Voltage DC V' = | 11.29 | 4.71 | 16.00 | 16.00 |
| Power DC W' = | 32.00 | 13.28 | 512.00 | 557.28 |
| $W'_M / W_M$ =32.00/16.00=2 | | | | |
| $W'_{Total} / W_{Total}$ =557.28/288.00=1.94 | | | | |

Fig. 15

MULTIPLE-SETTING PORTABLE DRYER AND CIRCUIT DESIGNS THEREOF

BACKGROUND OF INVENTION

1. Field of the Invention

The present invention relates to a portable dryer, and more particularly, to a multiple-setting portable dryer and related circuit designs.

2. Description of the Prior Art

The conventional dryer is operable only after establishing connection with an AC power plug through a power cord. The use of the dryer is then limited by the length of the cord to the area that can be reached by the cord from the AC power receptacle. Therefore, it is very inconvenient for travelling purposes, in particular, when traveling in countries where the AC power specifications, such as voltages, cycles, and receptacles vary from one to another. Different converters and transformers are needed if the user wants to use a conventional dryer. Furthermore, since the conventional AC powered dryers are powered by AC currents with sinusoidal amplitudes, most use a diode to control the generation of heat. When the switch is shifted to low heat, the one-way conduction property of the diode filters out a half cycle of the AC current that passes through the heating filament. When the switch is shifted to high heat, the current to the heating filament does not go through the diode so that heat can be generated in full output. At the same time, in order to provide a DC current to the motor, an additional bridge rectifier has to be employed to supply the needed DC power.

A typical portable dryer is disclosed in U.S. Pat. No. 6,327,428, which is incorporated herein by reference. The portable dryer comprises a plurality of heating filaments for generating different levels of heat. A motor of the portable dryer is capable of running at different speeds so that a fan of the portable dryer can blow different volumes of air and heat for the convenience of the user.

SUMMARY OF INVENTION

It is a primary object of this invention to provide a multiple-setting portable dryer having advantageous circuit designs.

According to one embodiment of the invention, the portable dryer includes a housing, a power unit for supplying electric power to the portable dryer, a motor having a fan installed inside the housing, four heating filaments electrically connected to the power unit for generating heat, and a switch electrically connected to the power unit. When the portable dryer operates, the power unit supplies electric power to the motor and the heating filaments, causing the heating filaments to generate heat, and the motor to drive the fan and thus blow out hot air generated by the heating filaments. When the switch is turned to a first operation position, the motor electrically connects to a first heating filament in series and then to a third heating filament in parallel. When the switch is turned to a second operation position, both the first heating filament and a second heating filament are electrically connected in parallel and electrically connected to the motor in series and then to the third heating filament and a fourth heating filament in parallel. Therefore, the speed of the motor can be controlled by the switch to obtain different levels of airflow and heat.

In another embodiment of the present invention, when the switch is turned to the second operation position, the first heating filament is electrically disconnected to the power unit, and the motor electrically connects to the second heating filament in series and then to both the third heating filament and the fourth heating filament in parallel.

In another embodiment of the present invention, when the switch is turned to the second operation position, the third heating filament is electrically disconnected to the power unit, and both the first heating filament and the second heating filament are electrically connected in parallel and electrically connected to the motor in series and then to the fourth heating filament in parallel.

In another embodiment of the present invention, when the switch is turned to the second operation position, the first heating filament and the third heating filament are electrically disconnected to the power unit, and the motor electrically connects to the second heating filament in series and then to the fourth heating filament in parallel.

These and other objectives of the present invention will no doubt become obvious to those of ordinary skill in the art after reading the following detailed description of the preferred embodiment which is illustrated in the various figures and drawings.

BRIEF DESCRIPTION OF DRAWINGS

FIG. 5 shows the calculation of power generated from the first circuit in FIGS. 2–4.

FIG. 11 shows the calculation of power generated from a circuit of a portable dryer having the switch in FIG. 10.

FIG. 13 shows the calculation of power generated from a circuit of a portable dryer having the switch in FIG. 12.

FIG. 15 shows the calculation of power generated from a circuit of a portable dryer having the switch in FIG. 14.

DETAILED DESCRIPTION

Figure 1:
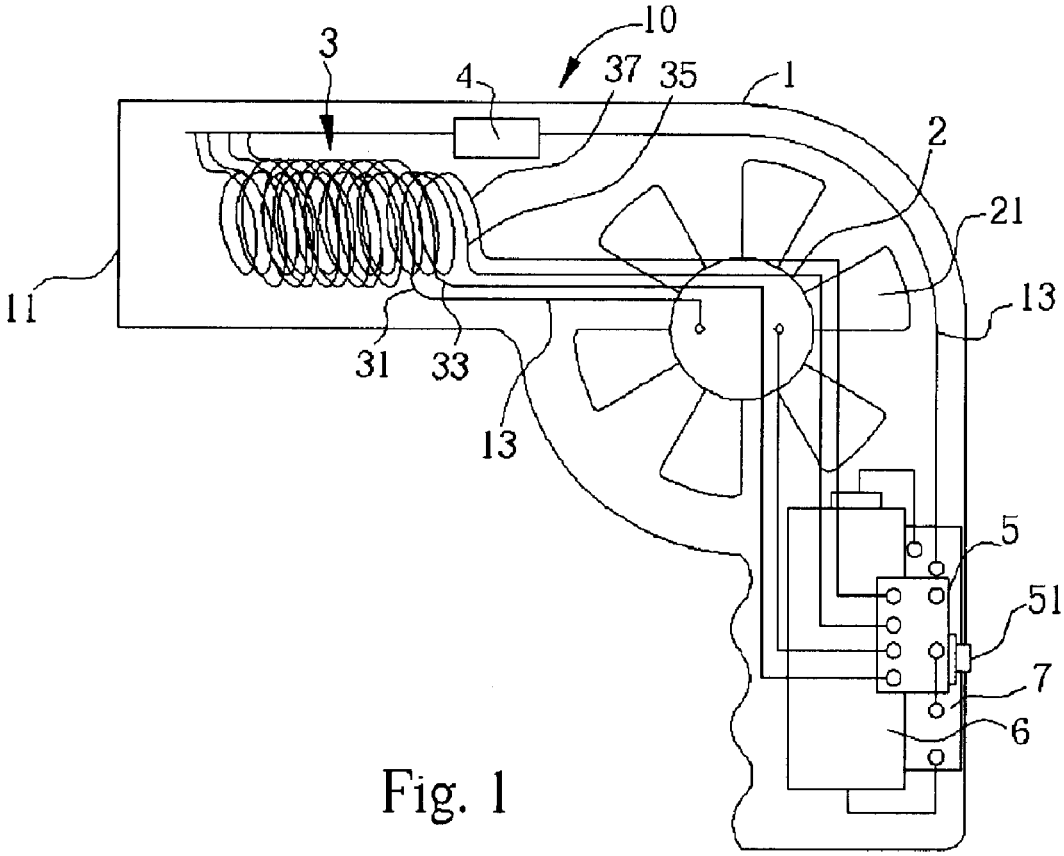
FIG. 1 is a schematic view of a portable dryer according to the present invention.

Please refer to FIG. 1, which is a schematic view of a portable dryer 10 according to the present invention. The portable dryer 10 has a housing 1 with an opening 11 on one end thereof, a power unit6 installed in the housing 1 for supplying electric power to the portable dryer 10, a motor 2 installed inside the housing 1, an electric heating element 3 electrically connected to the power unit 6 for generating heat, and an overload protection device 4 electrically connected to the power unit 6 for preventing damage to the portable dryer 10. In the preferred embodiment, the overload protection device 4 could be a fuse or a thermal switch. However, this should not be construed to mean that only fuses could be used as overload protection devices. The portable dryer 10 further includes a switch 5 and a transformer (voltage booster) 7. The switch 5 is electrically connected to the power unit 6, the motor 2, and the electric heating element 3. The booster 7 is electrically connected to the power unit 6 for boosting the voltage level of the power unit 6 so that a greater voltage level is output to the motor 2 and the electric heating element 3.

The power unit 6 can be a storage battery, dry-cell battery, a rechargeable battery, a fuel cell, or a micro-electro-mechanical system (MEMS) capable of outputting electric energy. It is connected to the motor 2, the electric heating element 3, the overload protection device 4, and the switch 5 via wires 13, forming a closed circuit loop. A fan 21 is coupled to the motor 2 so that the motor 2 can rotate the fan 21 to produce airflow. The electric heating element 3 comprises a first heating filament 31, a second heating filament 33, a third heating filament 35, and a fourth heating filament 37 (in the current embodiment, the four heating filaments 31, 33, 35, 37 can each be formed by more than one heating filament). The first heating filament 31 and the second heating filament 33 first connect to the motor 2 in series, which are then connected to the third heating filament 35 and fourth heating filament 37 in parallel, the circuit thus formed is then connected to the switch 5 and the overload protection device 4. The switch 5 is provided with a movable, seesaw, or rotatable button 51 with one end protruding out of the housing 1 so that a user can control the switch 5 by using the button 51.

With the above configuration, the user can push or rotate the button 51 to an on position so that electric power is supplied from the power unit 6 to the motor 2 and the electric heating element 3, causing the electric heating element 3 to generate heat and the motor 2 to drive the fan 21 so that hot air generated by the electric heating element 3 is blown out of the housing 1 from the opening 11. Since the electric power is supplied by the power unit 6, the use of the dryer will not be limited by the length of a wire connecting the dryer and a receptacle.

Figure 2:
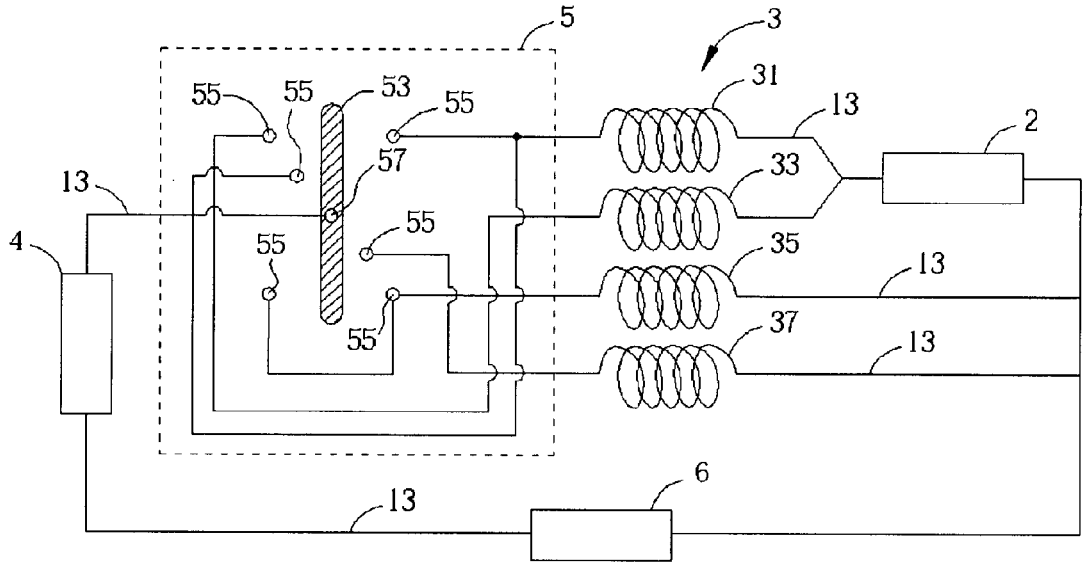
FIGS. 2 to 4 are circuit diagrams of a first circuit according to the present invention.
Figure 3:
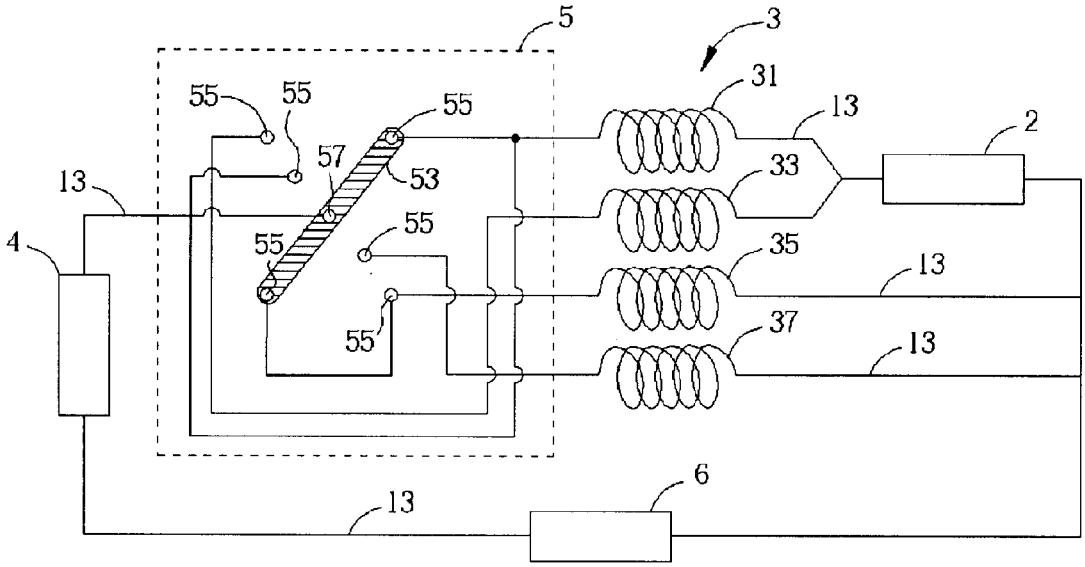
Figure 4:
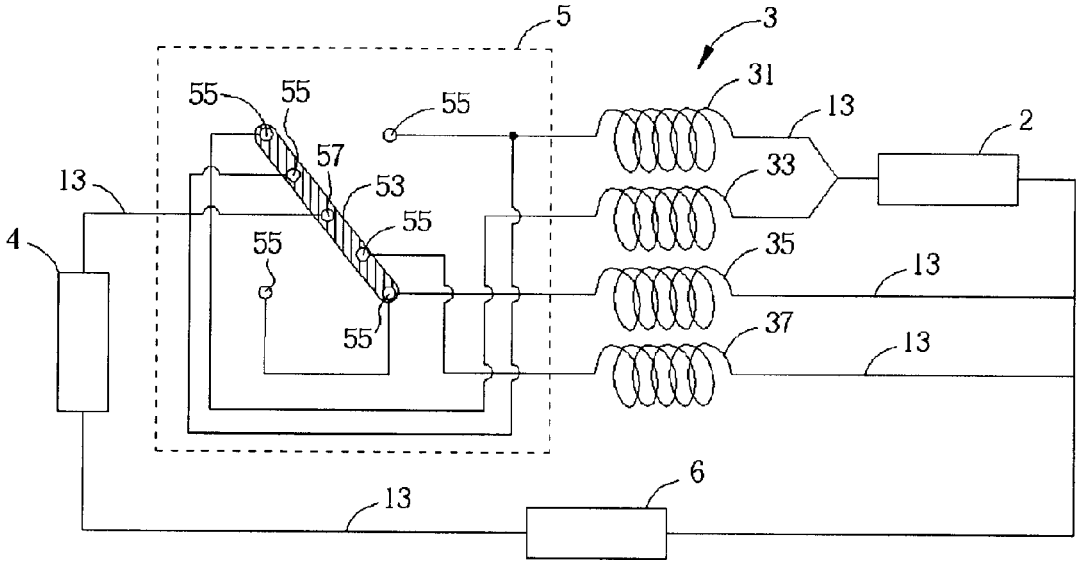

Please refer to FIGS. 2 to 4, which are circuit diagrams of a first circuit according to the present invention. In this embodiment, the switch 5 comprises a fan shaped conductor 53 and a plurality of connecting nodes 55. The conductor 53 is coupled to the power unit 6 via a wire 13, and the conductor 53 is rotatable about a pivot 57 of the switch 5. The power unit 6 is coupled to the overload protection device 4, the four heating filaments 31, 33, 35, 37, and the motor 2, forming a closed circuit loop. When the conductor 53 is not rotated, the power unit 6 is not electrically connected to the motor 2 and the electric heating element 3 (as shown in FIG. 2) so that the motor 2 does not run and the electric heating element 3 does not generate heat.

By turning the switch 5 to a first operation position (as shown in FIG. 3), the conductor 53 is rotated so that the motor 2 and the first and third heating filaments 31, 35 are electrically connected to the power unit 6, forming a closed circuit loop powered by the power unit 6. The motor 2 electrically connects to the first heating filament 31 in series and to the third heating filament 35 in parallel. In this case, the second and fourth heating filaments 33, 37 are electrically disconnected from the power unit 6. Since the resistance of the overload protection device 4 is relatively small compared with the motor 2 and the heating filaments 31, 33, 35, 37, it is ignored henceforth. We then have:

the total resistance $R=R_3(R_M+R1)/(R_M+R_1+R_3)$, where $R_M$ is the internal resistance of the motor 2, $R_1$ is the resistance of the first heating filament 31, and $R_3$ is the resistance of the third heating filament 35;

the total current $I=V(R_{M+R1}+R_3)/R_3(R_M+R_1)$, where V is the total output voltage of the power unit 6; the voltage difference between both ends of the motor 2 is $V_M=R_M\cdot V/(R_M+R_1)$;

the power generated by the motor 2 is $W_M=R_M\cdot V^2/(R_M+R_1)^2$; and the total power is $W=(R_M+R_1+R_3)V^2/R_3(R_M+R_1)$.

By turning the switch 5 to a second operation position (as shown in FIG. 4), the conductor 53 is rotated to electrically connect to the power unit 6 with the four heating filaments 31, 33, 35, 37 and the motor 2. The first and second heating filaments 31, 33 are electrically connected in parallel and electrically connected to the motor 2 in series and to the third and fourth heating filaments 35, 37 in parallel. Therefore, we have:

the total resistance $R'=R_3R_4(R_MR_1+R_MR_2+R_1R_2)/[R_3R_4(R_1+R_2)+(R_3+R_4)(R_MR_1+R_MR_2+R_1R_2)]$, where $R_2$ is the resistance of the second heating filament 33, and $R_4$ is the resistance of the fourth heating filament 37;

the total current $I'=V\cdot[R_3R_4\ (R_1+R_2)+(R_3+R_4)(R_MR_1+R_MR_2+R_1R_2)]/R_3R_4(R_MR_1+R_MR_2+R_1R_2)$, where V is the total output voltage of the power unit 6;

the voltage difference between both ends of the motor 2 is $V'_M=R_M(R_1+R_2)\cdot V/(R_MR_1+R_MR_2+R_1R_2)$;

the current on the motor 2 is $I'_M=(R_1+R_2)\cdot V/(R_MR_1+R_MR_2+R_1R_2)$;

the power generated by the motor 2 is $W'_M=R_M(R_1+R_2)^2\cdot V^2/(R_MR_1+R_MR_2+R_1+R_2)^2$; and the total power is $W'=V^2\cdot(R_3R_4\ (R_1+R_2)+(R_3+R_4)(R_MR_1+R_MR_2+R_1R_2)]/R_3R_4(R_MR_1+R_MR_2+R_1R_2)$.

Please reference FIG. 5, which shows power generated from the first circuit. One can calculate from the above equations that $W'_M/W_M=2$, which means that the rotational speed of the motor 2 is increased by a factor of 2. The total power ratio $W'/W=1.94$, which means that the heat is increased by a factor of 1.94. Therefore, the electric heating device 3 is capable of generating different amounts of heat and the motor 2 is capable of running at different speeds, allowing the fan 21 to blow out hot air with different speeds and temperatures.

Figure 6:
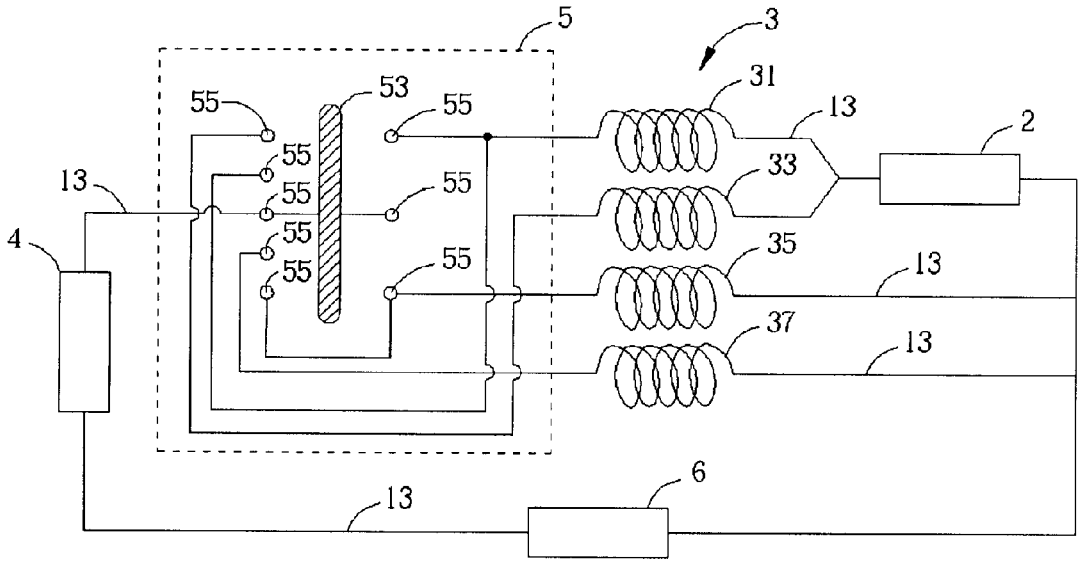
FIGS. 6 to 8 are circuit diagrams of a second circuit according to the present invention.
Figure 7:
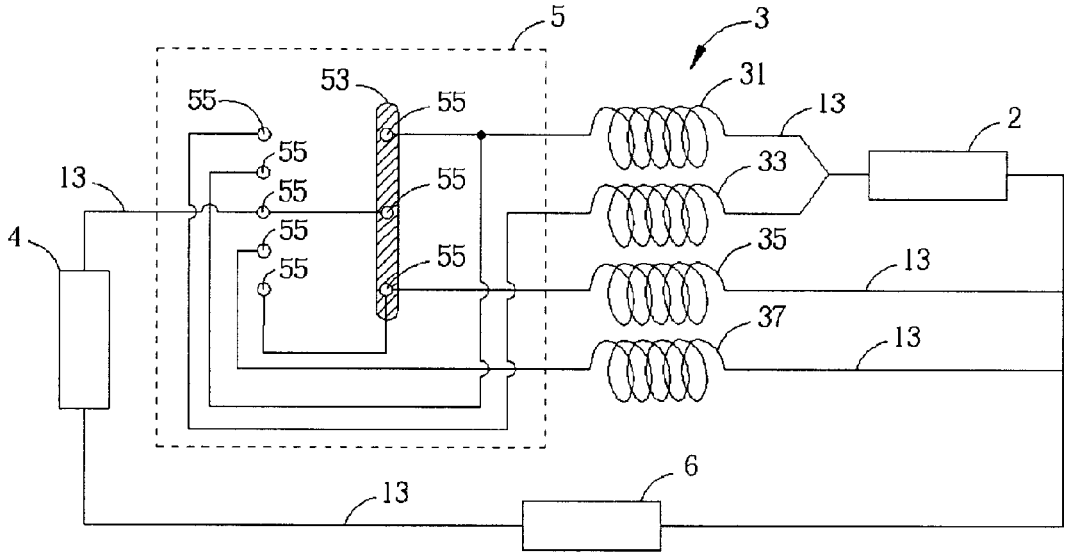
Figure 8:
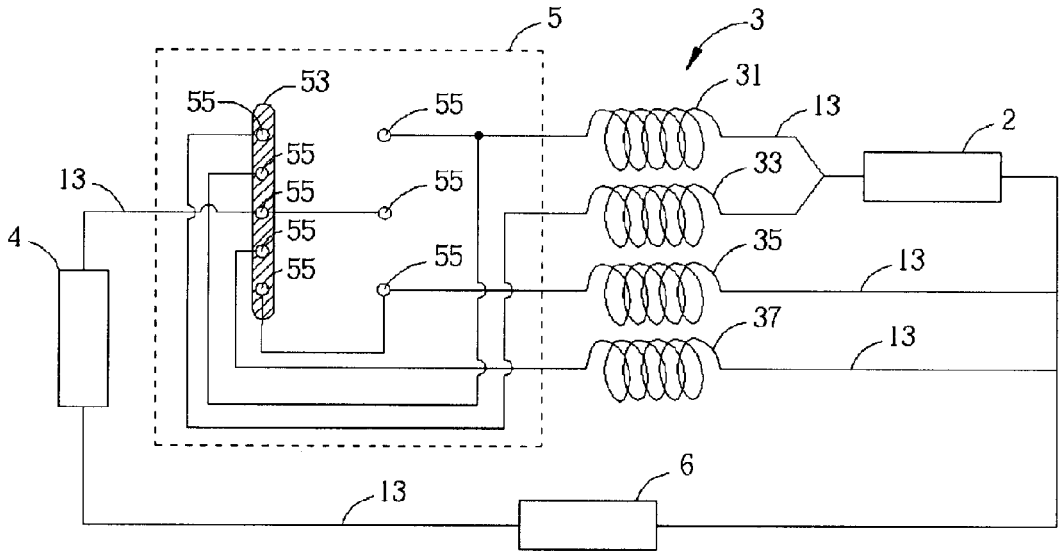

FIGS. 6 to 8 illustrate circuit diagrams of a second circuit according to the present invention. The switch 5 comprises a fan shaped conductor 53 and a plurality of connecting nodes 55. The conductor 53 is coupled to the power unit 6 via a wire 13. The connecting nodes 55 are coupled to an overload protection device 4, the heating filaments 31, 33, 35, 37, and the motor 2, forming a closed circuit loop. The conductor 53 can be positioned (or shifted) to electrically contact any of the plurality of connecting nodes 55. When the conductor 53 is not so positioned, the power unit 6 is not electrically connected with the motor 2 and the electric heating element 3 (as shown in FIG. 6) so that the motor 2 does not run and the electric heating element 3 does not generate heat.

By shifting the conductor 53 to a first operation position (as shown in FIG. 7), the motor 2 and the first and third heating filaments 31, 35 become electrically connected with the power unit 6, forming a closed circuit loop powered by the power unit 6. The motor 2 electrically connects to the first heating filament 31 in series and to the third heating filament 35 in parallel. The second and fourth heating filaments 33, 37 are electrically disconnected from the power unit 6. The situation is the same as that shown in FIG. 3.

By shifting the conductor 53 to a second operation position (as shown in FIG. 8), the conductor 53 electrically connects to the power unit 6 with the four heating filaments 31, 33, 35, 37 and the motor 2. The first and second heating filaments 31, 33 are electrically connected in parallel and electrically connected to the motor 2 in series and to the third and fourth heating filaments 35, 37 in parallel. The situation is the same as that shown in FIG. 4.

Figure 9:
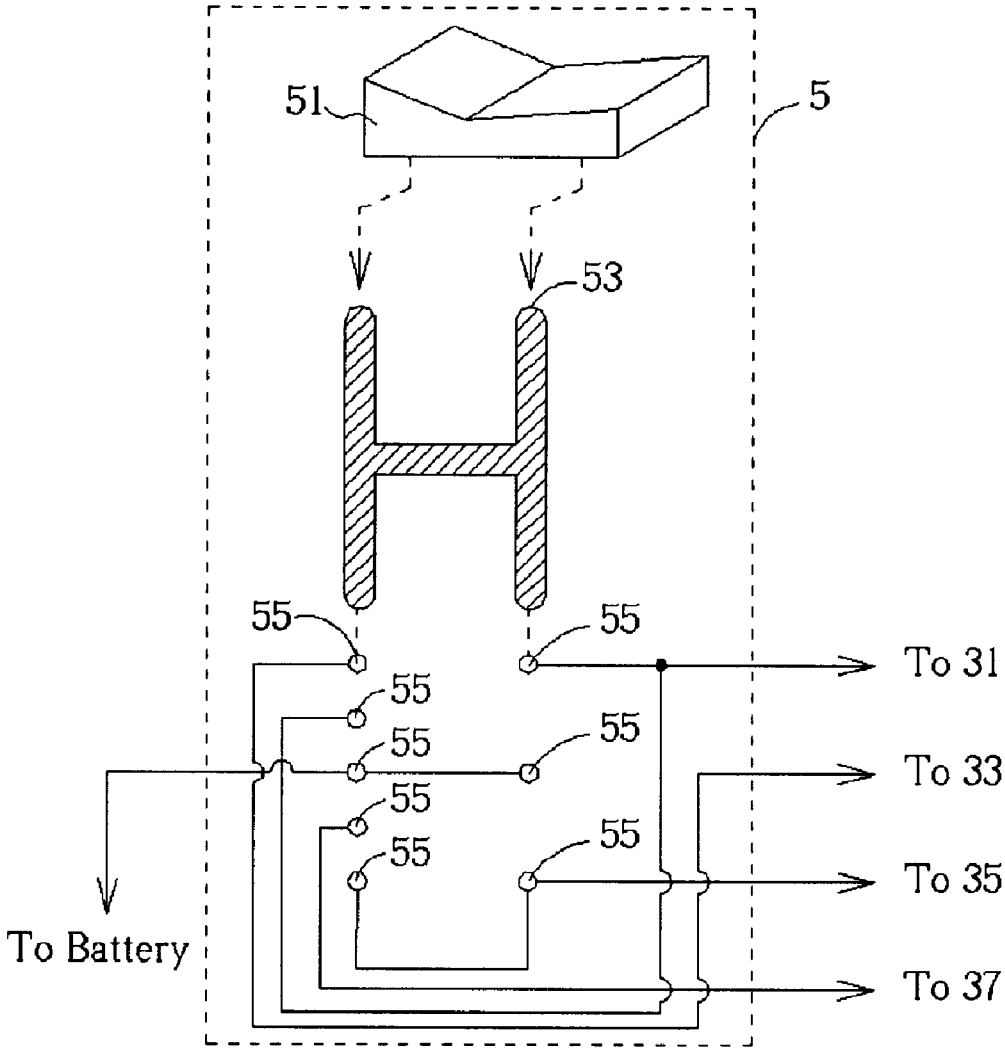
FIG. 9 shows exploded diagram of a third switch according to the present invention.

Please refer to FIG. 9, which shows an exploded diagram of a third switch 5 according to the present invention. In this embodiment, the switch 5 is a push-button switch and comprises a button, a conductor 53, and a plurality of connecting nodes 55. The conductor 53 is approximately "H" shaped. When the button 51 of the switch 5 is not pushed, the conductor 53 is not electrically connected to the connecting nodes 55. When the right side of the button 51 is pushed down, the conductor 53 electrically connects to three of the connecting nodes 55 so that the first and third heating filaments 31, 35 electrically connect to the power unit 6. When the left side of the button 51 is pushed down, the conductor 53 electrically connects to five of the connecting nodes 55 so that the four heating filaments 31, 33, 35, 37 electrically connect to the power unit 6.

Figure 10:
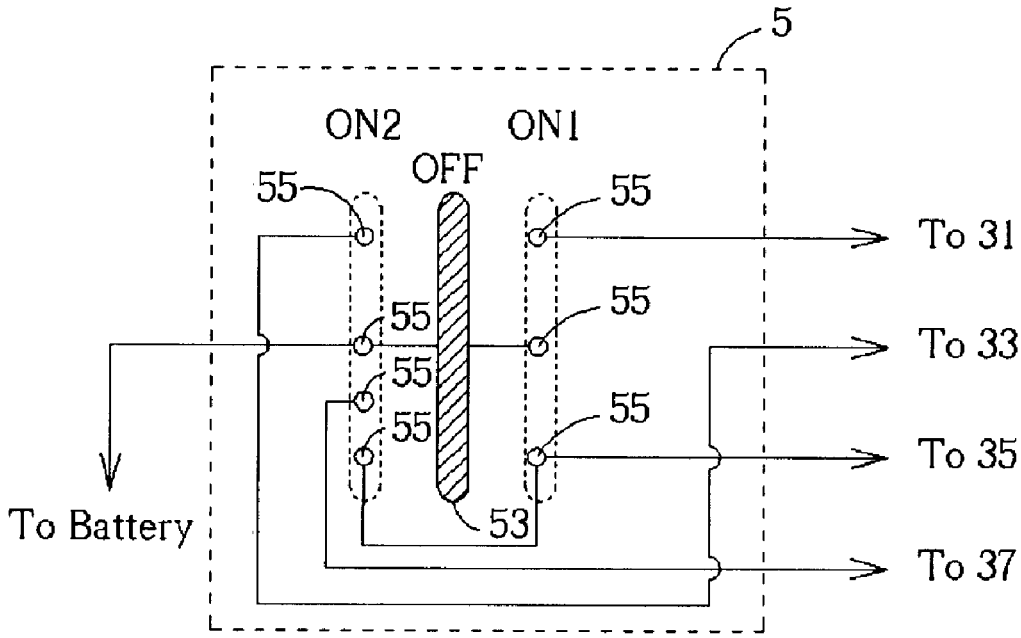
FIG. 10 shows a circuit diagram of a fourth circuit of a switch according to the present invention.

Please refer to FIG. 10, which shows a circuit diagram of a fourth circuit of a switch 5 according to the present invention. The switch 5 comprises a shiftable conductor 53 and a plurality of connecting nodes 55. Similar to the switch 5 shown in FIG. 7, in this embodiment, the conductor 53 is electrically disconnected from all the heating filaments 31, 33, 35, and 37 when the conductor 53 is positioned at an OFF position. When the conductor 53 is positioned at a first operation position ON1, the first and third heating filaments 31, 35 electrically connect to the power unit 6, and the second and fourth heating filaments 33, 37 are electrically disconnected from the power unit 6. However, when the conductor 53 is positioned at a second operation position ON2, the second, third and fourth heating filaments 33, 35, 37 electrically connect to the power unit 6, and the first heating filament 31 electrically disconnects from the power unit 6.

Please reference FIG. 11, which shows power generated from the fourth circuit. One can calculate that $W'_M/W_M+2$, which means that the rotational speed of the motor 2 is increased by a factor of 2. The total power ratio W'/W=1.94, which means that the heat is increased by a factor of 1.94. Therefore, the electric heating device of the portable dryer can generate different amounts of heat and the motor can run at different speeds, causing the fan to blow out hot air at different speeds and temperatures. It is noted that the resistance $R_2$ of the second heating filament 33 should be different to the resistance $R_1$ of the first heating filament 31 so that the rotational speed of the motor 2 will changed while the switch 5 is turned from the first operation position ON1 to the second operation position ON2.

Figure 12:
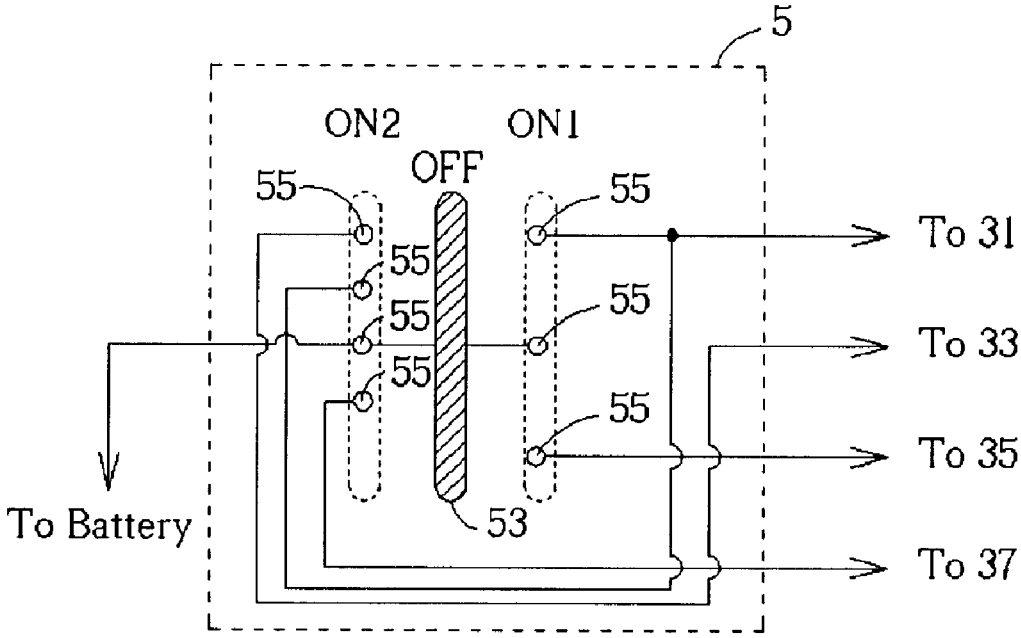
FIG. 12 shows a circuit diagram of a fifth circuit of a switch according to the present invention.

FIG. 12 shows a circuit diagram of a fifth circuit of a switch 5 according to the present invention. The switch 5 comprises a shiftable conductor 53 and a plurality of connecting nodes 55. Similar to the switch 5 shown in FIG. 10, in this embodiment, the conductor 53 is electrically disconnected from all of the heating filaments 31, 33, 35, and 37 when the conductor 53 is positioned at an OFF position. When the conductor 53 is positioned at a first operation position ON1, the first and third heating filaments 31, 35 are electrically connected to the power unit 6, and the second and fourth heating filaments 33, 37 are not electrically connected to the power unit 6. However, when the conductor 53 is positioned at a second operation position ON2, the first, second, and fourth heating filaments 31, 33, 37 are electrically connected to the power unit 6, and the third heating filament 35 is electrically disconnected from the power unit 6. In this embodiment, the resistance $R_3$ of the third heating filament 35 should be different from the resistance $R_4$ of the fourth heating filament 37 so that different levels of heat can be generated. For example, $R_3$=1 Ω and $R_4$=0.5 Ω. Please reference FIG. 13, which shows power generated from the fifth circuit. One can calculate that $W'_M/W_M=2$, which means that the rotational speed of the motor 2 is increased by a factor of 2. The total power ratio W'/W=1.94, which means that the heat is increased by a factor of 1.94.

Figure 14:
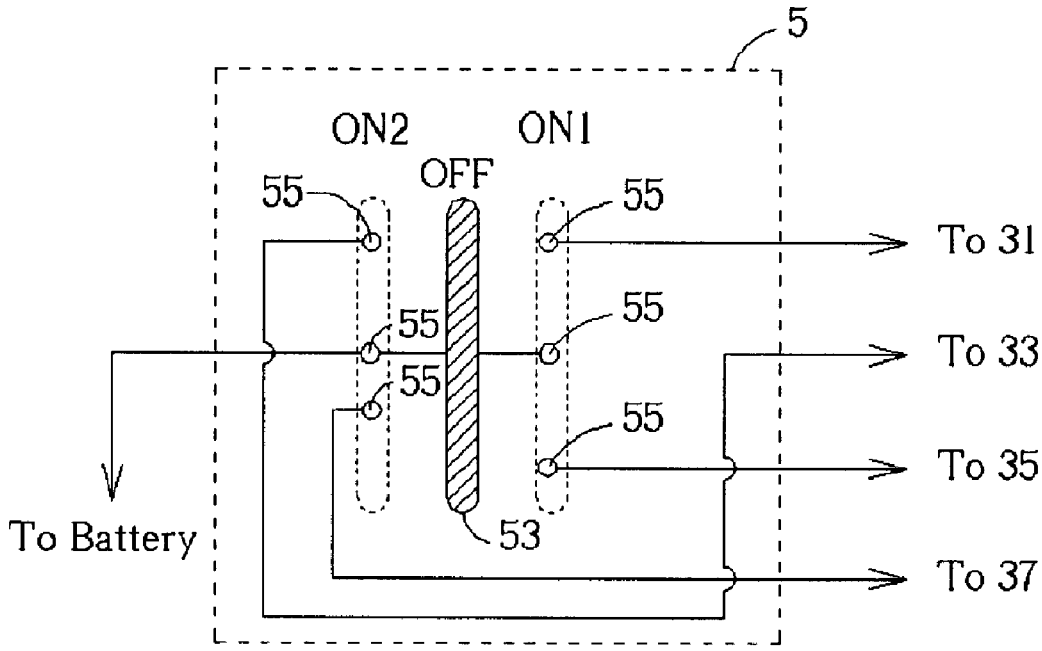
FIG. 14 shows a circuit diagram of a sixth circuit of a switch according to the present invention.

Please refer to FIG. 14, which shows a circuit diagram of a sixth circuit of a switch 5 according to the present invention. The switch 5 comprises a shiftable conductor 53 and a plurality of connecting nodes 55. Similar to the switch 5 shown in FIG. 10, in this embodiment, the conductor 53 is electrically disconnected from all the heating filaments 31, 33, 35, and 37 when the conductor 53 is positioned at an OFF position. When the conductor 53 is positioned at a first operation position ON1, the first and third heating filaments 31, 35 are electrically connected to the power unit 6, and the second and fourth heating, filaments 33, 37 are not electrically connected to the power unit 6. However, when the conductor 53 is positioned at a second operation position ON2, the second and fourth heating filaments 33, 37 are electrically connected to the power unit 6, and the first and the third heating filaments 31, 35 are electrically disconnected from the power unit 6. In the embodiment, the resistance $R_1$ of the first heating filament 31 should be different from the resistance $R_2$ of the second heating filament 33 so that the fan blows out different airflow. For example, $R_1$=4 Ω and $R_2$=1.67 Ω. The resistance $R_3$ of the third heating filament 35 should be different from the resistance $R_4$ of the fourth heating filament 37 so that different strengths of heat can be generated. For example, $R_3$=1 Ω and $R_4$=0.5 Ω. Please reference FIG. 15, which shows power generated from the sixth circuit. One can calculate that $W'_M/W_M=2$, which means that the rotational speed of the motor 2 is increased by a factor of 2. The total power ratio W'/W=1.94, which means that the heat is increased by a factor of 1.94.

Compared to the related art, the portable dryers of the present invention are powered by its own power units, not by power cords. Thus, their usage is not limited by proximity to power receptacles. Moreover, through different arrangements of the electric heating device, the power of the motor is related to the power of the heating filaments so that different strengths of heat can be generated and the motor therein can run at different speeds to allow the fan blow out different volumes of air and heat for the convenience of the user.

Those skilled in the art will readily observe that numerous modifications and alterations of the device may be made while retaining the teachings of the invention. Accordingly, the above disclosure should be understood to be limited only by the bounds of the following claims.

What is claimed is:

1. A portable dryer comprising:

a housing with an opening at one end thereof;

a motor having a fan installed inside the housing;

a first heating filament coupled to the motor;

a second heating filament coupled to the motor and the first heating filament;

a third heating filament;

a fourth heating filament coupled to the third heating filament;

a switch for controlling operations of the portable dryer; and a power unit for supplying electric power;

wherein the power unit is electrically disconnected from the motor and all electric heating filaments when the switch is turned to an off position, the motor is electrically connected to the first heating filament in series and then to the third heating filament in parallel when the switch is turned to a first operation position, and both the first heating filament and the second heating filament are electrically connected in parallel and electrically connected to the motor in series and then to both the third heating filament and the fourth heating filament in parallel when the switch is turned to a second operation position.

2. The portable dryer of claim 1, wherein when the switch is turned to the first operation position, the second heating filament and the fourth heating filament are electrically disconnected from the power unit.

3. The portable dryer of claim 1, wherein the switch comprises a conductor and a plurality of connecting nodes, the conductor able to establish electrical connections among the plurality of connecting nodes so that the power unit is electrically disconnected from the motor and the heating filaments, or electrically connected with both the motor and the third heating filament, or electrically connected with the motor, the third heating filament, and the fourth heating filament.

4. The portable dryer of claim 3, wherein the conductor is rotatably installed to establish electrical connections among the plurality of connecting nodes.

5. The portable dryer of claim 3, wherein the conductor is shiftable to establish electrical connections among the plurality of connecting nodes.

6. The portable dryer of claim 3, wherein the switch is a push-button switch.

7. The portable dryer of claim 1 further comprising a transformer electrically connected to the power unit for boosting an outputted voltage level of the power unit.

8. The portable dryer of claim 1 further comprising an overload protection device electrically connected to the power unit for preventing damage to the portable dryer.

9. A portable dryer comprising:

a housing with an opening at one end thereof;

a motor having a fan installed inside the housing;

a first heating filament coupled to the motor;

a second heating filament coupled to the motor and the first heating filament;

a third heating filament;

a fourth heating filament coupled to the third heating filament;

a switch for controlling operations of the portable dryer; and a power unit for supplying electric power;

wherein the power unit is electrically disconnected from the motor and all electric heating filaments when the switch is turned to an off position, the motor is electrically connected to the first heating filament in series and then to the third heating filament in parallel when the switch is turned to a first operation position, and the first heating filament is electrically disconnected to the power unit and the motor is electrically connected to the second heating filament in series and then to the third heating filament and the fourth heating filament in parallel when the switch is turned to a second operation position.

10. The portable dryer of claim 9, wherein when the switch is turned to the first operation position, the second heating filament and the fourth heating filament are electrically disconnected from the power unit.

11. The portable dryer of claim 9, wherein the switch comprises a conductor and a plurality of connecting nodes, the conductor able to establish electrical connections among the plurality of connecting nodes so that the power unit is electrically disconnected from the motor and the heating filaments, or electrically connected with both the motor and the third heating filament, or electrically connected with the motor, the third heating filament, and the fourth heating filament.

12. The portable dryer of claim 11, wherein the conductor is rotatably installed to establish electrical connections among the plurality of connecting nodes.

13. The portable dryer of claim 11, wherein the conductor is shiftable to establish electrical connections among the plurality of connecting nodes.

14. The portable dryer of claim 11, wherein the switch is a push-button switch.

15. The portable dryer of claim 9 further comprising a transformer electrically connected to the power unit for boosting an outputted voltage level of the power unit.

16. The portable dryer of claim 9 further comprising an overload protection device electrically connected to the power unit for preventing damage to the portable dryer.

17. A portable dryer comprising:

a housing with an opening at one end thereof;

a motor having a fan installed inside the housing;

a first heating filament coupled to the motor;

a second heating filament coupled to the motor and the first heating filament;

a third heating filament;

a fourth heating filament coupled to the third heating filament;

a switch for controlling operations of the portable dryer; and a power unit for supplying electric power;

wherein the power unit is electrically disconnected from the motor and all electric heating filaments when the switch is turned to an off position, the motor is electrically connected to the first heating filament in series and then to the third heating filament in parallel when the switch is turned to a first operation position, and the third heating filament is electrically disconnected to the power unit and both the first heating filament and the second heating filament are connected in parallel and electrically connected to the motor in series and then to the fourth heating filament in parallel when the switch is turned to a second operation position.

18. The portable dryer of claim 17, wherein when the switch is turned to the first operation position, the second heating filament and the fourth heating filament are electrically disconnected from the power unit.

19. The portable dryer of claim 17, wherein the switch comprises a conductor and a plurality of connecting nodes, the conductor able to establish electrical connections among the plurality of connecting nodes so that the power unit is electrically disconnected from the motor and the heating filaments, or electrically connected with both the motor and the third heating filament, or electrically connected with both the motor and the fourth heating filament.

20. The portable dryer of claim 19, wherein the conductor is rotatably installed to establish electrical connections among the plurality of connecting nodes.

21. The portable dryer of claim 19, wherein the conductor is shiftable to establish electrical connections among the plurality of connecting nodes.

22. The portable dryer of claim 19, wherein the switch is a push-button switch.

23. The portable dryer of claim 17 further comprising a transformer electrically connected to the power unit for boosting an outputted voltage level of the power unit.

24. The portable dryer of claim 17 further comprising an overload protection device electrically connected to the power unit for preventing damage to the portable dryer.

25. A portable dryer comprising:

a housing with an opening at one end thereof;

a motor having a fan installed inside the housing;

a first heating filament coupled to the motor;

a second heating filament coupled to the motor and the first heating filament;

a third heating filament;

a fourth heating filament coupled to the third heating filament;

a switch for controlling operations of the portable dryer; and a power unit for supplying electric power;

wherein the power unit is electrically disconnected from the motor and all electric heating filaments when the switch is turned to an off position, the motor is electrically connected to the first heating filament in series and then to the third heating filament in parallel when the switch is turned to a first operation position, and the first heating filament and the third heating filament are electrically disconnected to the power unit and the motor is electrically connected to the second heating filament in series and then to the fourth heating filament in parallel when the switch is turned to a second operation position.

26. The portable dryer of claim 25, wherein when the switch is turned to the first operation position, the second heating filament and the fourth heating filament are electrically disconnected from the power unit.

27. The portable dryer of claim 25, wherein the switch comprises a conductor and a plurality of connecting nodes, the conductor able to establish electrical connections among the plurality of connecting nodes so that the power unit is electrically disconnected from the motor and the heating filaments, or electrically connected with both the motor and the third heating filament, or electrically connected with both the motor and the fourth heating filament.

28. The portable dryer of claim 27, wherein the conductor is rotatably installed to establish electrical connections among the plurality of connecting nodes.

29. The portable dryer of claim 27, wherein the conductor is shiftable to establish electrical connections among the plurality of connecting nodes.

30. The portable dryer of claim 27, wherein the switch is a push-button switch.

31. The portable dryer of claim 25 further comprising a transformer electrically connected to the power unit for boosting an outputted voltage level of the power unit.

32. The portable dryer of claim 25 further comprising an overload protection device electrically connected to the power unit for preventing damage to the portable dryer.

* * * * *